United States Patent [19]

Nilsson et al.

[11] Patent Number: 4,479,982

[45] Date of Patent: Oct. 30, 1984

[54] METHOD FOR PRODUCING A LYOPHOBIC LAYER

[75] Inventors: Kenth Nilsson, Akersberga, Sweden; Rolf Schulte, Erlangen, Fed. Rep. of Germany

[73] Assignee: Siemens Aktiengesellschaft, Berlin & Munich, Fed. Rep. of Germany

[21] Appl. No.: 486,004

[22] Filed: Apr. 18, 1983

[30] Foreign Application Priority Data

Apr. 21, 1982 [DE] Fed. Rep. of Germany ..... 3214804

[51] Int. Cl.[3] ..... B05D 3/14

[52] U.S. Cl. ..... 427/41; 346/140 PD

[58] Field of Search ..... 427/41; 346/140 PD

[56] References Cited

U.S. PATENT DOCUMENTS 3,946,398 3/1976 Kyser et al. ..... 346/140 PD
4,072,959 2/1978 Elmqvist ..... 346/140 R
4,252,848 2/1981 Datta et al. ..... 427/41
4,312,575 1/1982 Peyman et al. ..... 427/41
4,343,013 8/1982 Bader et al. ..... 346/140 PD

FOREIGN PATENT DOCUMENTS 2527647 12/1976 Fed. Rep. of Germany .

OTHER PUBLICATIONS

Baker *IBM Tech. Disc. Bull.*, vol. 22, No. 5, 10-1979 pp. 1965, 1966.

*Primary Examiner*—John H. Newsome
*Attorney, Agent, or Firm*—Hill, Van Santen, Steadman & Simpson

[57] ABSTRACT

A lyophobic layer is produced on surfaces of a jet-orifice carrier of a recording device functioning with fluid droplets by generating a uniform and pore-free layer on surfaces of the carrier with the application of high frequency/low pressure glow discharge using a gaseous organic compound, such as octofluorocyclobutane.

6 Claims, 1 Drawing Figure

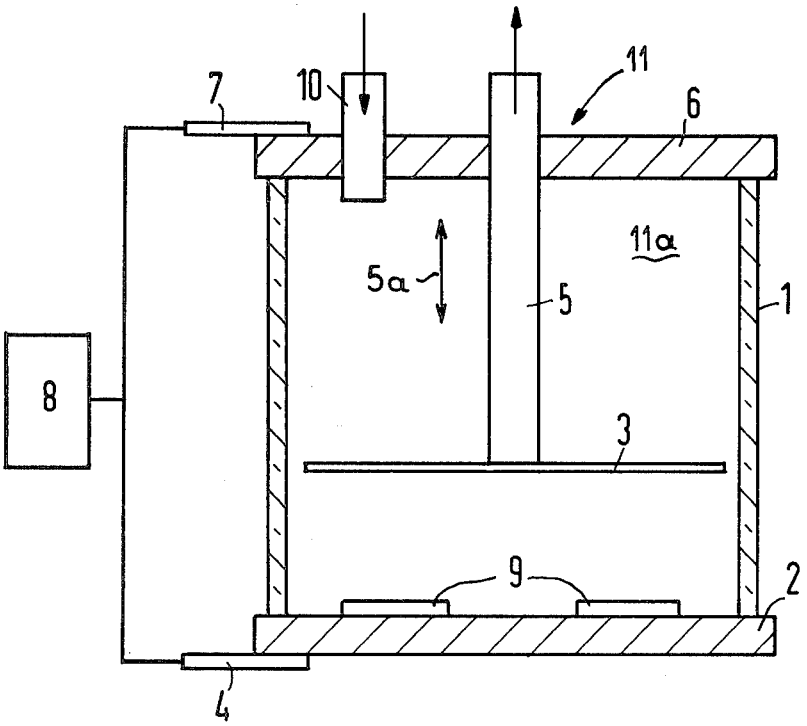
7
10
11
6
11a
5a
5
1
8
3
9
2
4

METHOD FOR PRODUCING A LYOPHOBIC LAYER

BACKGROUND OF THE INVENTION

1. Field of the Invention

The invention relates to a method of producing a synthetic lyophobic layer and somewhat more particularly to a method of producing a lyophobic layer on surfaces of a jet-orifice carrier of a recording device functioning with liquid droplets.

2. Prior Art

Recording devices functioning by controllably ejecting liquid droplets through a jet-orifice are known, for example, from German OS No. 25 27 647. In this type of device, at least one jet-orifice is provided in a carrier for recording indicia with a writing fluid being ejected from the jet-orifice as needed and being applied to a recording medium disposed in front of the discharge opening of the jet-orifice.

In order to prevent a surface of the jet-orifice carrier facing a recording media from being moistened by oozing writing fluid and thereby producing recorded artifacts which disrupt print quality, this carrier surface can be provided with a layer of material which exhibits a surface tension lower than that of the writing fluids. These lyophobic, i.e. liquid-repelling, layers can be composed of synthetic materials such as polyethylene or, preferably, polytetrafluoroethylene.

As is known, polytetrafluoroethylene layers can be produced by sintering a powder or dispersion of particulate polytetrafluoroethylene raw material. However, it is difficult to control the coating thickness of layers produced in this manner. Further, the coated surfaces become slightly granular and partial coverage of surfaces defining the jet-orifice is difficult to avoid.

SUMMARY OF THE INVENTION

The invention provides a method of producing a lyophobic layer having required low surface tension and which has a uniform thickness and is pore-free, which does not cover or interfere with the jet-orifice opening and whose thickness is easy to control. Lyophobic layers are produced in accordance with the principles of the invention also have good adhesion and exhibit a good resistance to abrasion and scratching.

In accordance with the principles of the invention, a lyophobic layer composed of an organic compound is directly produced on the surfaces of a jet-orifice carrier by the application of a high frequency/low pressure glow discharge to a gaseous organic compound.

In practicing the principles of the invention, jet-orifice carriers are positioned in an operational pressure-controllable glow discharge chamber, which, after evacuation, is flooded with a gaseous organic compound, preferably a fluorine-containing organic compound, so that a pressure of about $10^{-2}$ to 10 mbar is attained and maintained within the chamber. A high frequency source is coupled, for example, to spaced-part electrodes within the discharge chamber and in working relation with the jet-orifice carrier so that upon energization a high frequency glow discharge is ignited in the chamber and a thin layer of, for example, a fluorine polymer, is directly formed on the surfaces of the jet-orifice carrier during the chronological course of the high frequency glow discharge. The coupling of high frequency energy to the glow discharge chamber (sometimes referred to as a vacuum chamber) can occur in a known manner, either capacitively with the assistance of two electrodes positioned inside or outside the chamber or inductively with the assistance of a coil positioned around the chamber. The excitation frequency utilized is in the range of about 0.1 through 30 megahertz. The preferred fluorine-containing gaseous organic compounds used for coating are perfluoro-carbon compounds and can be selected from the group consisting of tetrafluoroethylene, hexafluoropropylene, perfluorobutylene, octofluorocyclobutane or perfluorocyclohexane. The preferred fluoropolymer layers obtained with the practice of the invention are very uniform and do not cover or interfere with the jet-orifice openings on the jet-orifice carriers; these layers exhibit adequate adhesion and resistance to abrasion and scratching and provide a long service life and the layer thicknesses can be controlled in a very simple manner via control of the duration of the glow discharge.

BRIEF DESCRIPTION OF THE DRAWING

The single FIGURE is an elevated, partially cross-sectional, and somewhat schematic view of an exemplary embodiment useful in the practice of the invention.

DESCRIPTION OF PREFERRED EMBODIMENTS

In the exemplary embodiment illustrated, a capacitive coupling of a high frequency energy source to a glow discharge chamber is described. An apparatus 11 having an operation glow discharge or vacuum chamber 11*a* is shown as comprised of a glass cylinder 1 and having two electrodes 2 and 3. The electrode 2 is connected to a high frequency generator 8 over a connecting line or terminal 4. The electrode 3 is connected to the high frequency generator 8 over an appropriately conductive gas discharge tube 5, which is axially moveable in the direction of arrow 5*a*, and is connected to a vacuum pump (not shown) for evacuating chamber 10*a* of spent gases, as required. The tube 5 is electrically coupled with removeable cover member 6, which in turn is connected to a connecting line or terminal 7 coupled to the generator 8.

A gas inlet tube 10 is provided through cover member 6 and is connected to a controllable gas source (not shown) providing a select gaseous organic compound, such as a fluorine-containing organic compound, to the chamber 11*a*. A carrier gas may also be provided from the same or a different gas source.

A plurality of jet-orifice carriers 9 to be coated can be simultaneously positioned on the electrode 2, which can be provided with a heat-exchange means (not shown), such as a hydraulic circuit having circulating cooling water therein. As shown, two jet-orifice carriers 9 are positioned on top of the electrode 2. The electrode 3, with attached discharge tube 5, can be adjusted in terms of spacing from electrode 2 in a known manner (schematically illustrated via arrow 5*a* ) so that any desired spacing between electrodes 2 and 3 can be readily obtained.

After emplacement of the jet-orifice carriers, the chamber 11*a* is closed and evacuated to approximately to $10^{-3}$ mbar through the discharge tube 5 with a vacuum pump. Subsequently, a gaseous organic compound, such as octofluorocyclobutane ($C_4F_8$), is controllably fed into the chamber 11*a* through the gas inlet tube 10. The suction power of the vacuum pump is then reduced to such a degree by a conventional throttle or choke valve (not shown) in the gas discharge tube 5 so that a working pressure of about 1.0 mbar is maintained within the chamber. A high frequency voltage provided by the high frequency generator 8 is then applied to the terminals 4 and 7 for igniting a glow discharge between the electrodes. The excitation frequency utilized is about 1 megahertz. A uniform lyophobic layer, approximately 0.7 μum in thickness is formed on the surfaces of the jet-orifice carriers in the course of about 5 minutes.

As is apparent from the foregoing specification, the present invention is susceptible of being embodied with various alterations and modifications which may differ particularly from those that have been described in the precedings specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. A method of producing a lyophobic layer on surfaces of a jet-orifice carrier of a recording device functioning with fluid droplets, comprising:

positioning at least one jet-orifice carrier in an operational pressure-controllable glow discharge chamber having a means for producing a glow discharge therein, said means being connected to a controllable high-frequency energy source, said chamber being connected to a controllable source of a gaseous organic compound;

feeding said gaseous organic compound into said chamber; and providing a high frequency energy in the range from about 0.1 to 30 megahertz to said means so that a high frequency/low pressure glow discharge occurs within said chamber and a lyophobic layer is directly produced on surfaces of said jet-orifice carrier.

2. A method as defined in claim 1 wherein said gaseous organic compound is a fluorine-containing organic compound.

3. A method as defined in claim 1 wherein said gaseous organic compound is a perfluoro-carbon compound.

4. A method as defined in claim 1 wherein said gaseous organic compound is selected from the group consisting of tetrafluoroethylene, hexafluoropropylene, perfluorobutylene, octofluorocyclobutane and perfluorocyclohexane.

5. A method as defined in claim 1 wherein said gaseous organic compound is fed into said discharge chamber at a gas pressure in the range of about $10^{-2}$ to 10 mbar and said pressure is maintained during the glow discharge.

6. In a method as defined in claim 1 where the produced lyophobic layer on surfaces of the jet-orifice carrier has a uniform thickness of about 0.7 μum.

* * * * *